US005781975A

United States Patent [19]

Wells, Jr. et al.

[11] Patent Number: 5,781,975

[45] Date of Patent: Jul. 21, 1998

[54] FLEXIBLE PLATFORM FOR CABLE TIE BARB

[75] Inventors: Peter M. Wells, Jr., Germantown; George Robertson, Memphis, both of Tenn.

[73] Assignee: Thomas & Betts Corporation, Memphis, Tenn.

[21] Appl. No.: 815,778

[22] Filed: Mar. 12, 1997

[51] Int. Cl.[6] ..... B65D 63/14

[52] U.S. Cl. ..... 24/16 PB; 24/30.5 P

[58] Field of Search ..... 24/16 R, 16 PB, 24/17 AP, 30.5 R, 30.5 P; 248/74.3; 292/318, 322

[56] References Cited

U.S. PATENT DOCUMENTS 3,186,047 6/1965 Schwester et al. .
3,488,813 1/1970 Kohke .
3,965,538 6/1976 Caveney et al. .
4,498,507 2/1985 Thompson .
5,121,524 6/1992 Mortensen .
5,193,251 3/1993 Fortsch .
5,513,421 5/1996 Wells .
5,517,727 5/1996 Bernard et al. .

*Primary Examiner*—James R. Brittain
*Attorney, Agent, or Firm*—Hoffmann & Baron, LLP

[57] ABSTRACT

A bundling tie having a head at one end, a tail at the other end, and a central strap body therebetween. The head includes a strap ingress face for receiving the strap and a strap egress face from which the inserted strap exits the head. The head further includes a central passageway in communication with the strap ingress face and the strap egress face for receipt of the tail. A metallic locking barb is embedded into a flexible foundation in the head. The flexible foundation is partially defined by a channel around the foundation. The channel provides increased barb rotation upon strap insertion into the head while also providing a stop surface that requires greater barb deflection upon attempt to withdraw the strap from the head.

5 Claims, 2 Drawing Sheets

FLEXIBLE PLATFORM FOR CABLE TIE BARB

FIELD OF THE INVENTION

The present invention relates generally to the field of cable ties. More particularly, the present invention relates to a cable tie having an improved head design for reducing the force required for inserting the tail of the cable tie thereinto.

BACKGROUND OF THE INVENTION

The use of cable ties to bundle or secure a group of articles is well known. Known cable ties of conventional construction are elongate members having a head at one end, a tail at the other end, and a longitudinal strap therebetween. The strap is wrapped around a bundle of articles and the tail is inserted through an aperture or passage in the head. The head of the cable tie typically includes a locking element which is engagable with the body of the strap so that when the tail is pulled through the aperture in the head, the locking element secures the strap body in the head.

From an ergonomic and performance perspective, a cable tie should ideally require low insertion forces to engage the strap in the head while also providing high long-term loop tensile strength for better securement of the bundle. Two distinct approaches have emerged for attaining these dual goals of cable tie design. The first approach, as demonstrated by U.S. Pat. No. 3,965,538, forms a one-piece cable tie where the locking element is formed integrally within the head of the cable tie. Such cable ties require relatively low insertion forces but provide relatively lower long-term loop tensile strength. The second approach to cable tie design employs a metal barb embedded in the head at an acute angle to the inserted tail. The metal barb bites into the strap upon any attempt to withdraw the strap therefrom. These cable ties generally require a relatively higher insertion force but provide a relatively higher long-term loop tensile strength as well.

Previous attempts to reduce the insertion force required for cable ties having an embedded metallic locking barb recognize that it can be easier to rotate a metallic locking barb than it is to bend a metallic locking barb. Rotation of a locking barb occurs when the portion of the cable tie head in which the barb is embedded is caused to deflect prior to or simultaneously with the barb being caused to bend. Deflection of a locking barb refers to the longitudinal bending of the locking barb. As it is generally easier to deflect plastic than steel, deflecting the plastic in the penetration area of the head, instead of the metallic barb or a combination of both the plastic and the barb, can reduce the required insertion force for a cable tie design. Alternatively stated, the more the barb is able to rotate due to the deflection of the plastic head, the less the barb will need to actually bend and the lower will be the force required to insert the strap past the locking barb.

One method for aiding barb rotation is simply to reduce the depth of barb penetration. With less plastic to resist the bending moment created by the insertion forces on the distal end of the locking barb, the plastic can be more easily deflected and the barb is thus more easily rotated. However, reduced barb penetration can also reduce the ability of the head to securely retain the barb therein.

Other methods for reducing the insertion force required for an embedded-barb cable tie look to other means of reducing the amount of plastic that must be deflected to provide barb rotation.

U.S. Pat. No. 5,717,727 discloses a cable tie having an embedded metallic locking barb and a support portion rising from the embedding surface to one side of the barb. A cored-out pocket is formed on the opposite side of the support portion to allow the barb to rotate slightly during strap insertion. The cored-out pocket extends less than the deepest penetration of the barb to provide barb secureness or to hold the barb in place until the cable tie is assembled.

U.S. Pat. No. 5,121,524 discloses a cable tie having a metallic locking barb embedded in a pivotally mounted pawl. A separate stop-wall is also provided to engage the barb so as to prevent both the over-rotation of the barb and the over-deflection of the barb in the strap removal direction. Because the stop-wall serves both functions, the pawl of the '524 patent therefore neither limits the rotation nor the deflection of the barb in the strap removal direction. Furthermore, because the stop wall includes through-apertures on both the side for strap insertion and on the side where the flexible pawl sits, the head design of the '524 patent is subject to mis-threading by a user attempting to insert the strap between the stop wall and the flexible pawl.

In view of a desire to reduce the insertion force required to insert a strap through the head of a cable tie having an embedded metallic barb, it is desirable to provide a cable tie having a head that supports the barb in a foundation that flexes during strap insertion and prevents both over-rotation and over-deflection of the barb in the strap removal direction.

SUMMARY OF THE INVENTION

It is an object of the present invention to provide a cable tie that provides high long-term loop tensile strength.

It is another object of the present invention to provide a cable tie with an embedded metallic locking barb that requires relatively lower insertion forces to insert the tail and strap of the cable tie through the head with the locking barb.

It is yet another object of the present invention to provide a cable tie having a metallic barb embedded in a flexible foundation in the head.

It is still another object of the present invention to provide a cable tie having a flexible foundation in the head that also serves to prevent over-rotation of an embedded metallic locking barb by forces attempting to withdraw the strap from the head.

In the efficient attainment of these and other objects, the present invention provides an elongate cable tie having a head at one end, a tail at the other end, and a central strap body therebetween. The head includes a strap ingress face for receiving the strap and a strap egress face from which the inserted strap exits the head. The head also includes a central passageway in communication with the strap ingress face and the strap egress face for receipt of the tail. The head also includes a metallic locking barb embedded into a flexible foundation protruding into the passageway. The flexible foundation is partially defined by a channel around the foundation which provides increased flexibility to the foundation. The channel also defines a stop-surface which prevents over-rotation of the barb by forces attempting to withdraw the strap out from the head.

DETAILED DESCRIPTION OF THE PREFERRED EMBODIMENT

Figure 1:
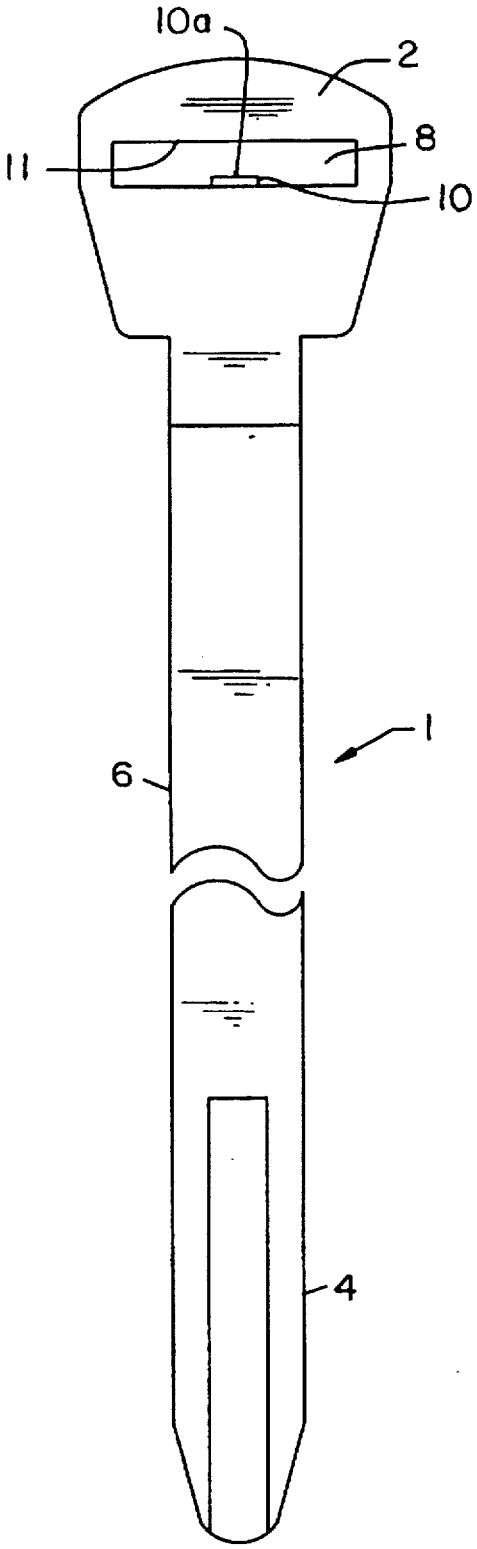
(PRIOR ART) FIG. 1
FIG. 1 shows a bottom plan view of a cable tie of the prior art.
Figure 2:
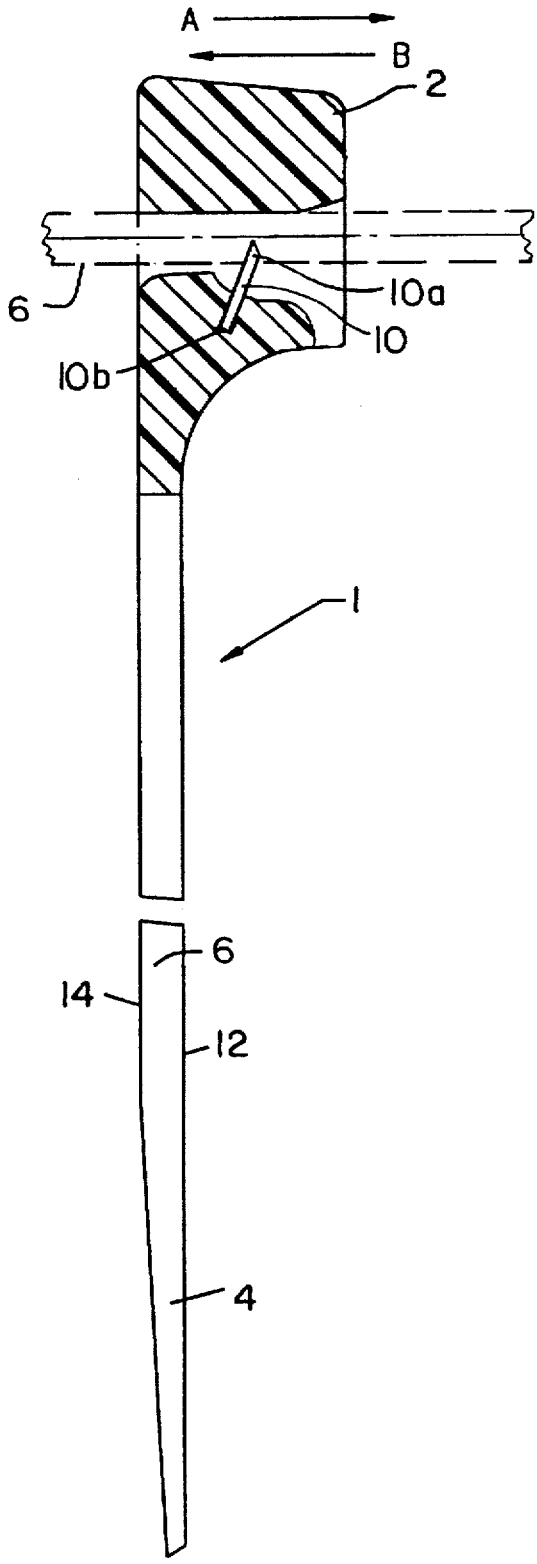
(PRIOR ART) FIG. 2
FIG. 2 is a side elevational view, partly in section, of the cable tie of FIG. 1.

FIGS. 1 and 2 show a cable tie 1 of the prior art. Cable tie 1 is an elongate member including a head 2, an opposed tail 4, and an elongate strap body 6 therebetween. Strap body 6 is typically planar shaped having first and second opposed surfaces 12 and 14. Head 2 includes a passageway 8 passing therethrough for receipt of tail 4 and strap body 6. Passageway 8 is defined by head wall 11. Head 2 also includes metallic locking barb 10 embedded within the head 2 which, as will be more fully discussed below, is positioned to engage strap body 6 when inserted through passageway 8 in the direction of arrow A.

Barb 10 is preferably formed of stainless steel and includes a knife-like end 10*a* extending into passageway 8. Barb 10 includes an opposing end 10*b* which extends into head 2 so as to allow barb end 10*a* to deflect in a cantilevered manner when tail 4 and strap 6 are inserted through passageway 8. The passage of strap 6 into passageway 8 is shown in FIG. 2 by phantom lines. As is common in barb type cable ties of the prior art, barb 10 is positioned in head 2 such that it provides biting engagement with strap 6 upon an attempt to withdraw the strap in the direction of arrow B.

As may be appreciated in order to insert strap 6 through passageway 8, barb 10 must bend or deflect in the direction of strap insertion shown by arrow A. The relatively deep penetration of barb 10 into head 2, which is provided to assure securement of the barb in the head, increases the difficulty of deflecting barb 10 during strap insertion and results in the relatively high insertion forces required for cable ties having an embedded metallic barb.

Figure 4:
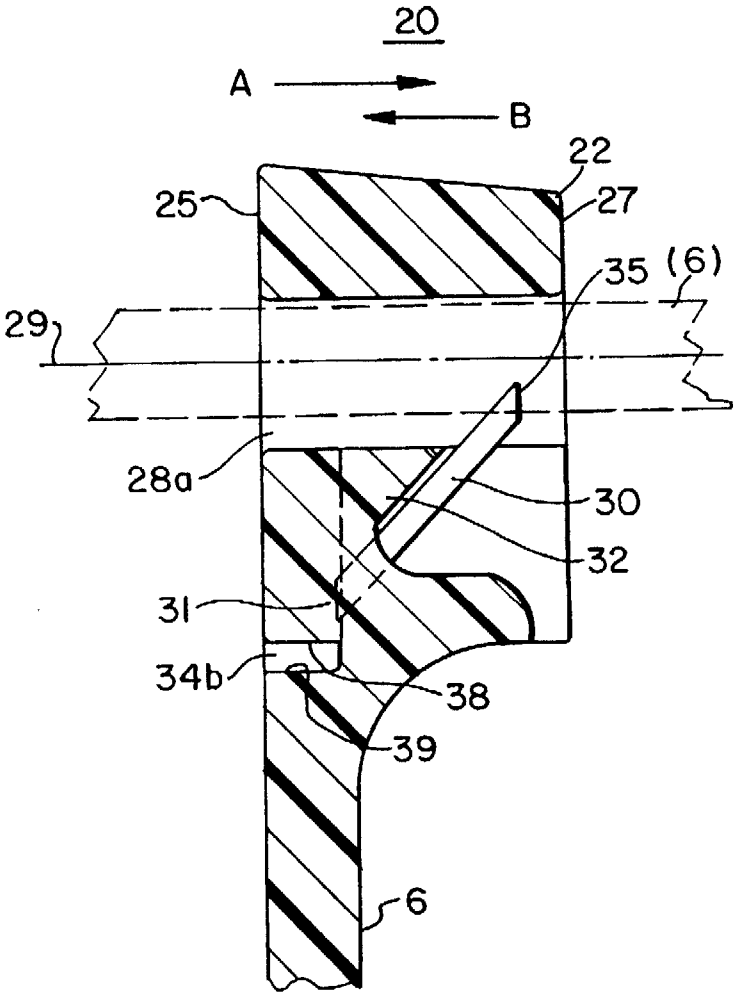
FIG. 4 is a cross-sectional view of an embodiment of the cable tie head of FIG. 3.
Figure 3:
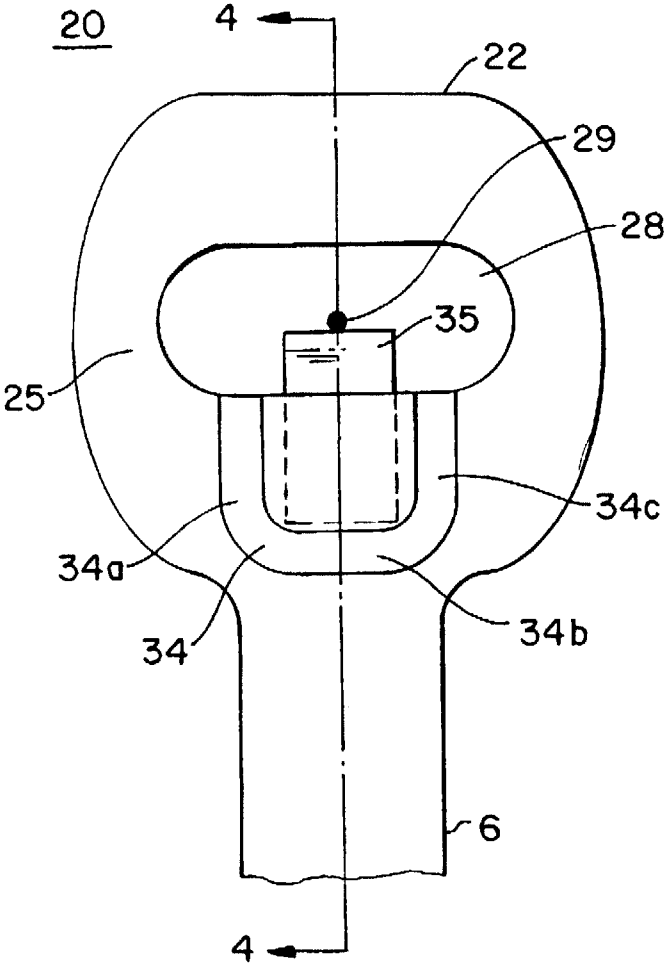
FIG. 3 is a bottom view of the head of the cable tie of the present invention.

FIGS. 3 and 4 detail the head portion of the improved cable tie 20 of the present invention. Cable tie 20 may include a strap 6 and tail 4 as known in the prior art and which herein retain the numbering of FIGS. 1 and 2. Cable tie 20 may be formed of a suitable plastic material such as nylon, polypropylene, or any other material familiar to the cable tie art. FIGS. 3 and 4 show that the present invention provides a modified head 22 having a strap ingress face 25, a strap egress face 27, and a passageway 28 communicating therebetween for accepting inserted tail 4 and strap 6. Tail 4 and strap 6 are inserted into passageway 28 through strap ingress face 25 and from there out through strap egress face 27. Head 22 includes metallic locking barb 30 embedded therein. Barb 30 is an elongate generally planar rectangular member having a knife-like edge 35 protruding into passageway 28. Edge 35 provides biting engagement of strap 6 inserted through passageway 28.

Barb 30 is supported in head 26 at an oblique angle such that knife-like edge 35 extends in passageway 28. The opposed end 36 is embedded into a central portion of head 22 deeming a flexible barb foundation 31. The depth of barb penetration into foundation 31 is in the range of 0.40 inches to 0.90 inches. Such depth of penetration is sufficient to provide secure embedment of barb 30 within foundation 31. Flexible barb foundation 31 is designed to maximize barb rotation and minimize barb deflection in order to reduce the required force for inserting strap 6 through passageway 28 in the direction of arrow A. Flexible barb foundation 31 is formed by channel 34 which is formed in ingress face 25.

Channel 34 preferably includes three channel legs 34*a*, 34*b*, and 34*c* forming generally a U-shape. Preferably, channel legs 34*a* and 34*c* communicate with one end 28*a* of passageway 28 and are transversely spaced apart a distance such that embedded metallic locking barb 30, as viewed down the longitudinal axis 29 of passageway 28 and as shown in FIG. 3, may be supported in foundation 31 defined therebetween. Lower channel leg 34*b*, extending between legs 34*a* and 34*c*, is preferably spaced from passageway 28 a sufficient distance such that the deepest penetration of barb 30 in foundation 31 is permitted without barb penetration into channel 34*b*. The location of channel 34*b* below the deepest penetration of barb 30 in flexible barb foundation 31 further reduces the effective thickness of the foundation and thereby facilitates deflection of the foundation as a whole.

Forming channel 34 in accordance with the preferred embodiment allows flexible barb foundation 31 to deflect or rotate when strap 6 is inserted through passageway 28. Deflecting or rotating flexible barb foundation 31 will thereby further facilitate rotation of barb 30 and further minimize any bending of barb 30 required by insertion of strap 6 through passageway 28. Insertion forces can therefore be reduced by the inclusion of channel 34 in head 22.

Flexible barb foundation 31 further defines barb stop surface 32 adjacent barb 30. Barb stop surface 32 includes an angled surface 32*a* which generally matches the angle of insertion of barb 30 into barb foundation 31. Angled surface 32*a* projects forwardly toward the egressing face 27 of head 22. Barb stop surface 32 is provided in order to prevent over-rotation of barb 30 upon tensile forces applied in an attempt to withdraw strap 6 in the direction of arrow B. Barb stop surface 32 supports cantilevered extending portion 30*a* of barb 30 so as to prevent over-deflection of metallic barb 30 in the direction of arrow B. However, the barb remains able to rotate in the direction of arrow A upon insertion of the strap thereinto so as to reduce insertion forces.

As shown in FIG. 4, channel leg 34*b* is defined by opposing walls 38 and 39. Wall 39 acts as a foundation stop surface for wall 38 when withdrawal forces attempt to move inserted strap 6 in the direction of arrow B. The contact between wall 39 and wall 38 prevent the over-rotation of locking barb 30 in the strap removal direction shown by arrow B. Because barb rotation will thus be limited, withdrawal forces will have to bend metallic barb 30 to cause deflection of barb edge 35. Such barb bending is limited by barb stop surface 32. Loop tensile strength for the present invention will therefore remain relatively high.

In conventional operation known for cable ties, tail 4 is wrapped around a bundle of articles and inserted in direction A into passageway 28 through head 22. Strap 6, shown in FIG. 4 by phantom lines, extends through passageway 28, exiting head 22 through strap egress face 27. As the strap is similarly pulled through passageway 28, locking barb 30 is deflected in a cantilevered fashion in the direction of the strap travel. Strap 6 may pulled through head 22 until the cable tie tightly encircles the bundle of articles. Barb stop surface 32 prevents over-deflection of barb 30 when forces act to pull strap 6 in direction of arrow B back through passageway 28.

Upon an attempt to withdraw the strap 6 from head 22 in the direction of arrow B, knife-like edge 35 bites into strap body, continued attempt to withdraw the strap 6 from head 22 is prevented by the operation of barb stop surface 32 and the foundation stop surface formed by engagement of walls 38 and 39 as described above.

While the particular preferred embodiment of the present invention has been shown and described, it will be obvious to those skilled in the art that changes and modifications may be made without departing from the teachings of the invention. The matter set forth in the foregoing description and accompanying drawings is offered by way of illustration only and not as a limitation. The actual scope of the invention is intended to be defined in the following claims when viewed in their proper perspective based on the prior art.

What is claimed is:

1. A bundling tie comprising:

an elongate strap having a tail at one end;

a head having a strap ingress face, a strap egress face, and an aperture therethrough the head, said aperture communicating with said strap ingress face and said strap egress face for insertable receipt of said strap;

an elongate locking barb having one end embedded into said head said locking barb being engagable with said strap upon insertion of said strap into said aperture;

a flexible foundation portion in said head, said barb having a first end embedded in said foundation portion and having a second end extending into said aperture for locking engagement with said strap upon said insertion thereinto;

said foundation portion of said head being further defined by a U-shaped channel having first and second spaced-apart legs connected by a central leg formed in the strap ingress face of said head, said foundation portion being flexibly supported so at to be movable upon insertion of said strap to permit passage of said strap through said aperture;

wherein said channel further defines two opposing side walls defining two engagement surfaces for mutual engagement upon attempted movement of said strap in a withdrawal direction opposite said insertion and preventing over rotation of said foundation portion.

2. A bundling tie of claim 1 wherein said foundation further includes a barb stop surface adjacent said barb, said barb stop surface being in engagement with said barb for preventing over deflection of said barb upon said movement of said strap in said withdrawal direction.

3. A bundling tie according to claim 1 wherein said first and second legs of said channel communicate with said aperture through said head.

4. A bundling tie according to claim 3 wherein said first and second ends of said channel are transversely spaced a distance greater than the transverse width of said barb protruding into said aperture in said head.

5. A bundling tie according to claim 1 wherein the depth of said barb penetration into said foundation portion is in the range of 0.40 inches to 0.90 inches.

* * * * *